US008727490B2

(12) United States Patent
Kumagai et al.

(10) Patent No.: US 8,727,490 B2
(45) Date of Patent: May 20, 2014

(54) FLUID DISCHARGING APPARATUS

(75) Inventors: Toshio Kumagai, Shiojiri (JP); Kaoru Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

(21) Appl. No.: 12/357,116

(22) Filed: Jan. 21, 2009

(65) Prior Publication Data

US 2009/0185020 A1 Jul. 23, 2009

(30) Foreign Application Priority Data

Jan. 22, 2008 (JP) ..... 2008-011793

(51) Int. Cl.
*B41J 2/165* (2006.01)

(52) U.S. Cl.
USPC ..... 347/35

(58) Field of Classification Search
None
See application file for complete search history.

(56) References Cited

U.S. PATENT DOCUMENTS

| | | | | |
|---|---|---|---|---|
| 6,157,797 | A * | 12/2000 | Saito et al. | 399/107 |
| 6,851,787 | B2 * | 2/2005 | Johnson | 347/22 |
| 2006/0012670 | A1 * | 1/2006 | Tsujino et al. | 347/251 |
| 2006/0274135 | A1 * | 12/2006 | Ushirogouchi et al. | 347/96 |
| 2007/0171251 | A1 * | 7/2007 | Sekimoto et al. | 347/22 |
| 2008/0117253 | A1 * | 5/2008 | Yearout et al. | 347/36 |
| 2008/0238993 | A1 * | 10/2008 | Gomez et al. | 347/36 |

FOREIGN PATENT DOCUMENTS

| | | |
|---|---|---|
| JP | 05-008406 | 1/1993 |
| JP | 06-255129 | 9/1994 |
| JP | 2005-205912 | 8/2005 |
| JP | 2007-098617 A | 4/2007 |

* cited by examiner

*Primary Examiner* — Alejandro Valencia
(74) *Attorney, Agent, or Firm* — Workman Nydegger

(57) ABSTRACT

A fluid discharging apparatus includes: a nozzle for discharging fluid onto a medium; and a rotating body that has a holding region for holding the medium and a non-holding region on its peripheral surface and that rotates while facing the peripheral surface toward the nozzle. The rotating body includes a receiving member for receiving fluid discharged from the nozzle for flushing when the non-holding region faces the nozzle and a removing member for removing the fluid, received by the receiving member, from the receiving member.

9 Claims, 12 Drawing Sheets

FLUID DISCHARGING APPARATUS

CROSS-REFERENCE TO RELATED APPLICATIONS

This application claims priority under the Paris Convention based on Japanese Patent Application No. 2008-11793 (filed on Jan. 22, 2008).

BACKGROUND

1. Technical Field

The invention relates to a fluid discharging apparatus. More specifically, the invention relates to a fluid discharging apparatus that includes: a nozzle that discharges fluid onto a medium; and a rotating body that has a holding region for holding the medium and a non-holding region on its peripheral surface and that rotates while facing the peripheral surface toward the nozzle.

2. Related Art

A fluid discharging apparatus that includes a nozzle for discharging fluid onto a medium and a rotating body that has a holding region for holding the medium and a non-holding region on its peripheral surface and that rotates while facing the peripheral surface toward the nozzle is already known. In addition, in some fluid discharging apparatuses, the rotating body has a receiving member for receiving fluid discharged from the nozzle for flushing when the non-holding region faces the nozzle. Furthermore, some fluid discharging apparatuses include a removing member for removing fluid, received by the receiving member, from the receiving member (see, for example, JP-A-5-8406).

Incidentally, fluid received by the receiving member needs to be appropriately removed by the removing member. For this reason, in an existing fluid discharging apparatus, when the removing member removes fluid, received by the receiving member, from the receiving member, rotation of the rotating body is sometimes stopped. If rotation of the rotating body is stopped, the throughput of the fluid discharging apparatus may decrease.

SUMMARY

An advantage of some aspects of the invention is that it appropriately removes fluid, received by a receiving member, without decreasing the throughput of a fluid discharging apparatus.

An aspect of the invention provides a fluid discharging apparatus. The fluid discharging apparatus includes: a nozzle for discharging fluid onto a medium; and a rotating body that has a holding region for holding the medium and a non-holding region on its peripheral surface and that rotates while facing the peripheral surface toward the nozzle. The rotating body includes a receiving member for receiving fluid discharged from the nozzle for flushing when the non-holding region faces the nozzle and a removing member for removing the fluid, received by the receiving member, from the receiving member.

Other aspects of the invention will become apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
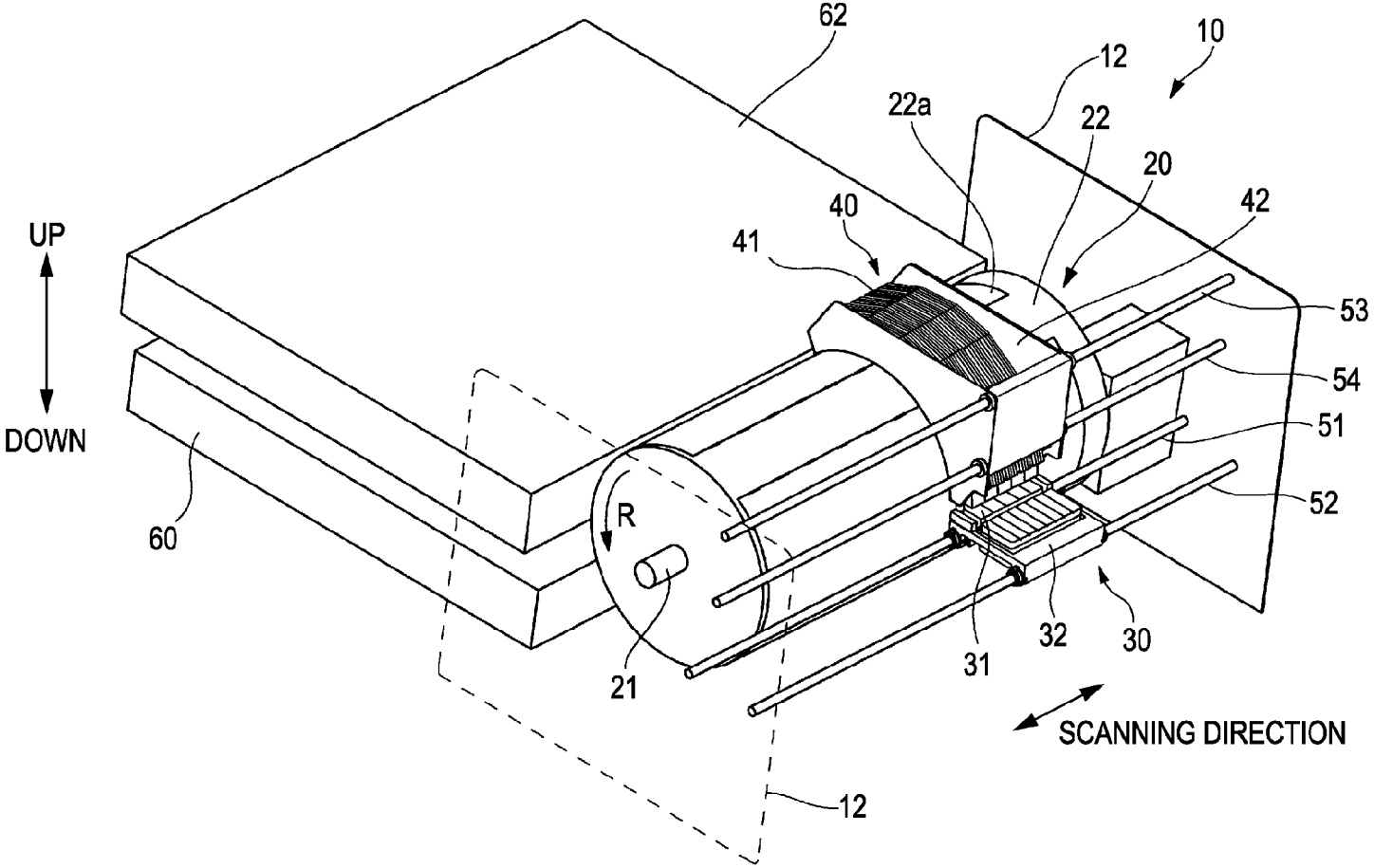
FIG. 1 is a perspective view that schematically shows the structure of a printer.

At least the following aspects become apparent from the specification and the accompanying drawings.

First, a fluid discharging apparatus includes: a nozzle for discharging fluid onto a medium; and a rotating body that has a holding region for holding the medium and a non-holding region on its peripheral surface and that rotates while facing the peripheral surface toward the nozzle. The rotating body includes a receiving member for receiving fluid discharged from the nozzle for flushing when the non-holding region faces the nozzle and a removing member for removing the fluid, received by the receiving member, from the receiving member. In the fluid discharging apparatus, because the rotating body includes both the receiving member and the removing member, the removing member appropriately removes fluid, received by the receiving member, from the receiving member without stopping rotation of the rotating body. That is, without decreasing the throughput of the fluid discharging apparatus, it is possible to appropriately remove fluid received by the receiving member.

In addition, in the fluid discharging apparatus, the rotating body may be a rotating drum that has an opening formed in the non-holding region, the receiving member may be a belt that rotates in a state where the belt is looped between two rollers inside the rotating drum while receiving fluid discharged from the nozzle for flushing and passing through the opening on its outer peripheral surface, and the removing member may be a scraping member that scrapes the fluid received by the belt in such a manner that the scraping member contacts the outer peripheral surface of the rotating belt. With the above fluid discharging apparatus, for example, even when a large amount of fluid are discharged from the nozzle through multiple flushings, the belt appropriately receives the fluid, and then the scraping member appropriately removes the fluid from the belt.

In addition, in the fluid discharging apparatus, the fluid may be an ultraviolet curable ink, the fluid discharging apparatus may further include an irradiation unit that faces the peripheral surface of the rotating drum at a position downstream of the nozzle in a direction in which the rotating drum rotates and that is used for irradiating ultraviolet ray to the ultraviolet curable ink that has adhered to the medium, the belt may move from a position facing the nozzle through the opening to a position facing the irradiation unit through the opening in accordance with rotation of the rotating drum, the irradiation unit may irradiate ultraviolet ray to ultraviolet curable ink, received by the belt when the belt is located at the position facing the nozzle, at the time when the belt is moved and located at a position facing the irradiation unit, and the scraping member may scrape the ultraviolet curable ink to which the ultraviolet ray is irradiated. The more the ultraviolet curable ink is cured, the easier the ultraviolet curable ink is scraped. Thus, with the above configured fluid discharging apparatus, it is possible to easily remove the ultraviolet curable ink received by the belt.

In addition, in the fluid discharging apparatus, the outer peripheral surface of the belt may move between an exposed position at which the outer peripheral surface is exposed through the opening and a non-exposed position at which the outer peripheral surface is not exposed as the belt rotates, and, after the outer peripheral surface, to which ultraviolet curable ink adheres at the time when the belt receives the ultraviolet curable ink, moves from the exposed position to the non-exposed position as the belt rotates, the scraping member may scrape the ultraviolet curable ink that has adhered to the outer peripheral surface. With the above fluid discharging apparatus, it is possible to ensure a long duration during which ultraviolet ray is irradiated to ultraviolet curable ink. As a result, because ultraviolet curable ink received by the belt is further cured, it is possible to further easily remove the ultraviolet curable ink.

In addition, in the above fluid discharging apparatus, the belt may rotate while moving from the position facing the nozzle through the opening to the position facing the irradiation unit through the opening in accordance with rotation of the rotating drum, and, after that, the belt may pass the position facing the irradiation unit, and a relative relationship in rotational speed between the belt and the rotating drum may be such that, while the rotating drum rotates one turn, the belt only rotates less than one turn. With the above fluid discharging apparatus, because ultraviolet curable ink received by the belt is further cured and then scraped, it is possible to further easily remove the ultraviolet curable ink.

In addition, in the above fluid discharging apparatus, the irradiation unit may irradiate ultraviolet ray at least during a period from the time when the belt initiates to face the irradiation unit through the opening to the time when the belt completes facing the irradiation unit through the opening in accordance with rotation of the rotating drum, and, at the time when the belt completes facing the irradiation unit, the outer peripheral surface, to which ultraviolet curable ink adheres at the time when the belt receives the ultraviolet curable ink, may be still located at the exposed position and have not reach the non-exposed position. With the above fluid discharging apparatus, because ultraviolet curable ink received by the belt is further cured and then scraped, it is possible to further easily remove the ultraviolet curable ink.

In addition, in the fluid discharging apparatus, the scraping member may move between a rest position at which the scraping member is spaced apart from the outer peripheral surface of the belt and a contact position at which the scraping member contacts the outer peripheral surface of the belt, the belt may move to the position facing the nozzle through the opening in each flushing in accordance with rotation of the rotating drum, may receive ultraviolet curable ink on a first outer peripheral surface that is located at the exposed position when the belt is located at the position facing the nozzle through the opening at one flushing while the scraping member is located at the rest position, and then may receive ultraviolet curable ink on a second outer peripheral surface, overlapped on the first outer peripheral surface, that is located at the exposed position when the belt is located at the position facing the nozzle through the opening at a flushing after the one flushing, and, after ultraviolet curable ink has adhered to both the first outer peripheral surface and the second outer peripheral surface, the scraping member may move from the rest position to the contact position to scrape the ultraviolet curable ink that has adhered to both the first and second outer peripheral surfaces. With the above fluid discharging apparatus, because ultraviolet curable ink received by the belt is further cured and then scraped, it is possible to further easily remove the ultraviolet curable ink.

In addition, the above fluid discharging apparatus may further include a transmission mechanism that transmits driving force from the rotating drum to one of the two rollers in order to rotate the belt. With the above fluid discharging apparatus, for example, it is not necessary to additionally provide a driving source for rotating the one of the two rollers and, therefore, it is possible to reduce the size of the fluid discharging apparatus.

In addition, in the fluid discharging apparatus, the belt may be made of a repellent material, and a silicon oil may be applied to the outer peripheral surface of the belt. With the above fluid discharging apparatus, because ultraviolet curable ink received by the belt is less likely to fixedly adhere to the outer peripheral surface even when it is cured, the ultraviolet curable ink is easily scraped.

In addition, in the fluid discharging apparatus, the belt and the scraping member may be detachable from a body of the rotating drum. With the above configuration, even when the belt and/or the scraping member degrade, it may be replaced with a new one.

Printer

Hereinafter, an ink jet printer (hereinafter, referred to as printer 10) will be described as an example of a fluid discharging apparatus according to the invention.

Configuration Example of Printer

Figure 2:
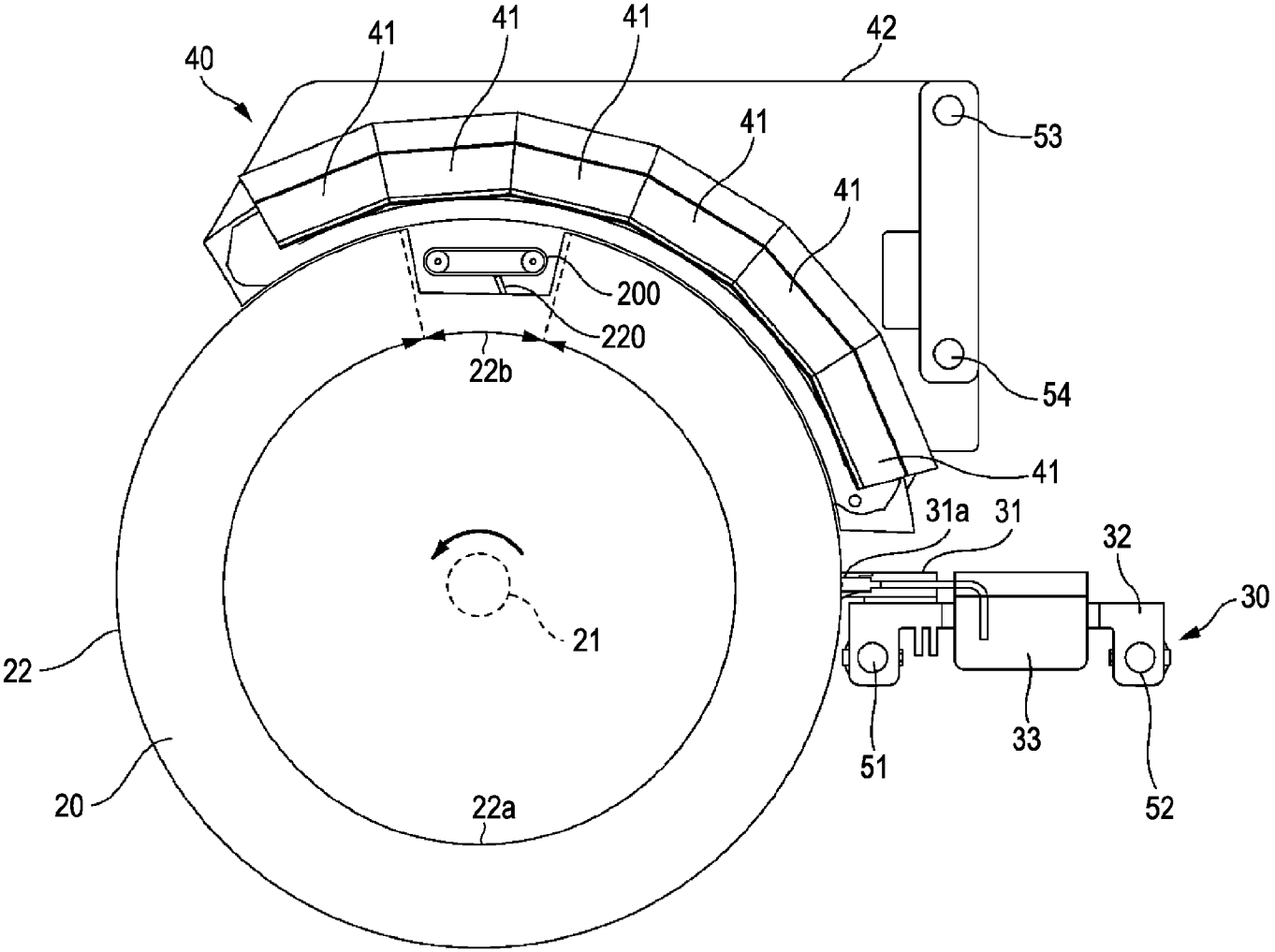
FIG. 2 is a cross-sectional view that shows the structure of a rotating drum and a peripheral device.

First, a configuration example of the printer 10 will be described with reference to FIG. 1 and FIG. 2. FIG. 1 is a perspective view that schematically shows the structure of the printer 10. Note that in FIG. 1, the vertical direction of the printer 10 and the direction in which heads 31 move (scanning direction) are indicated by the arrows. FIG. 2 is a cross-sectional view that shows the structure of a rotating drum 20 and a peripheral device. FIG. 2 shows a cross-sectional view that is taken in the direction perpendicular to the axial direction of a rotary shaft 21 of the rotating drum 20.

The printer 10 of the present embodiment, when receiving print data from a host computer (not shown) prints an image on a sheet of paper, which is an example of a medium, by discharging ultraviolet curing ink (hereinafter, UV ink), which is an example of fluid, onto the sheet of paper on the basis of the print data. Note that the UV ink of the present embodiment includes an additive compound that has a radical scavenging property to inhibit radical polymerization (so-called polymerization inhibitor).

As shown in FIG. 1, the printer 10 includes the rotating drum 20, a head unit 30, and a UV irradiation unit 40, which serves as an irradiation unit. The rotating drum 20 is a rotating body that rotates about the rotary shaft 21 while holding a sheet of paper on the peripheral surface 22. As shown in FIG. 1, the rotary shaft 21 is rotatably supported by a pair of frames 12 that extend upright and face each other, and rotates when driving force is transmitted from a drive motor (not shown).

Thus, the rotating drum 20 rotates about the rotary shaft 21 in a direction indicated by the arrow in FIG. 1.

In the present embodiment, as shown in FIG. 2, the peripheral surface 22 of the rotating drum 20 has a holding region 22*a* for holding a sheet of paper and a non-holding region 22*b* that does not hold a sheet of paper. Furthermore, an ink receiving belt 200, which is an example of a belt, and a scraper 220, which is an example of a scraping member, are provided inside the rotating drum 20. Note that the ink receiving belt 200 and the scraper 220 will be described later.

The head unit 30 discharges UV ink onto a sheet of paper that is held on the peripheral surface 22 (more accurately, holding region 22*a*) of the rotating drum 20. As shown in FIG. 2, the head unit 30 has the heads 31 and a head carriage 32 on which the heads 31 are mounted.

The heads 31 face the peripheral surface 22 of the rotating drum 20, and each have a nozzle surface 31*a* on which nozzles are formed. In other words, the rotating drum 20 rotates while facing the peripheral surface 22 toward the nozzles. The nozzles are used to discharge UV ink onto a sheet of paper that is held on the peripheral surface 22 of the rotating drum 20. The head carriage 32 is supported by guide shafts 51 and 52 extending along the rotary shaft 21 of the rotating drum 20, and reciprocally moves along the guide shafts 51 and 52. Thus, the heads 31 are reciprocally movable in the axial direction of the guide shafts 51 and 52 in accordance with movement of the head carriage 32. Note that as shown in FIG. 2, ink cartridges 33 that respectively contain UV inks are detachably attached to the head carriage 32.

The UV irradiation unit 40 irradiates ultraviolet ray to UV ink adhered on a sheet of paper. The UV irradiation unit 40 is located downstream of the head unit 30 (that is, located downstream of the nozzles) in the direction in which the rotating drum 20 rotates. In addition, the UV irradiation unit 40 includes a plurality of lamp units 41 that are aligned in the direction in which the rotating drum 20 rotates and an irradiation unit carriage 42 on which the plurality of lamp units 41 are mounted.

Each of the plurality of lamp units 41 has an irradiation surface that faces the peripheral surface 22 of the rotating drum 20. Then, each of the plurality of lamp units 41 irradiates ultraviolet ray, emitted from a light source (not shown), from the irradiation surface toward the peripheral surface 22 of the rotating drum 20. The irradiation unit carriage 42 is supported by guide shafts 53 and 54 extending along the rotary shaft 21 of the rotating drum 20, and moves along the guide shafts 53 and 54. Thus, the plurality of lamp units 41 move in the axial direction of the guide shafts 53 and 54 in accordance with movement of the irradiation unit carriage 42.

Nozzles

Figure 3:
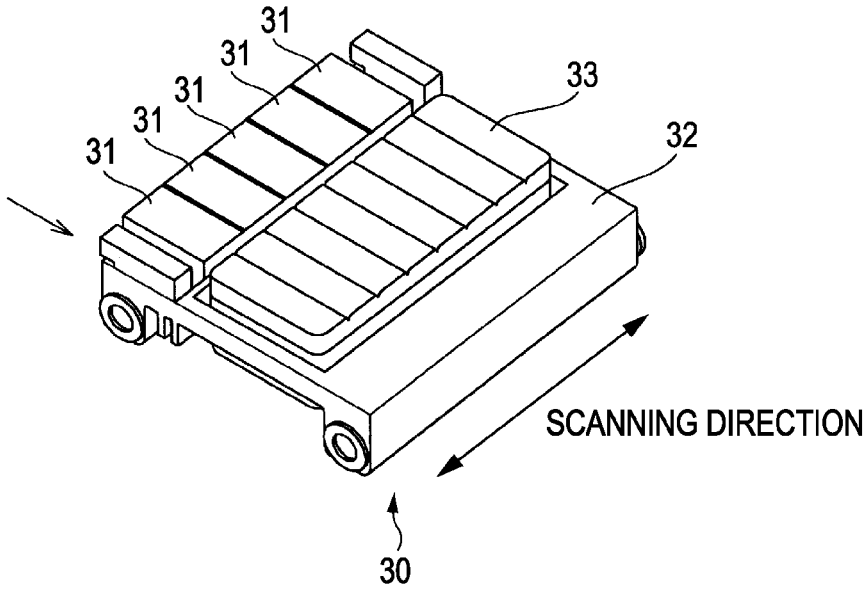
FIG. 3 is a perspective view of a head unit.
Figure 4:
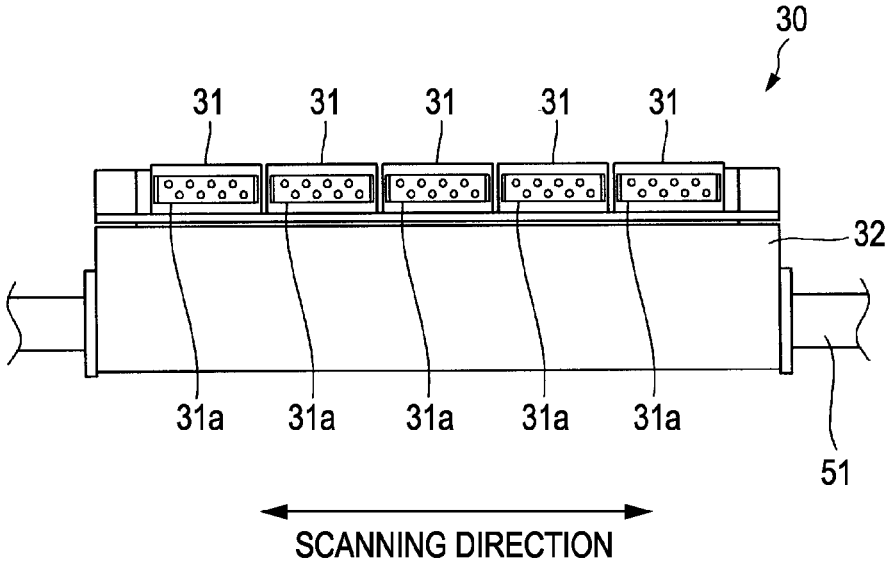
FIG. 4 is a view that shows nozzle surfaces.

Next, the nozzles formed on the nozzle surfaces 31*a* of the heads 31 will be described with reference to FIG. 3 and FIG. 4. FIG. 3 is a perspective view of the head unit 30. FIG. 4 is a view that shows the nozzle surfaces 31*a*, and is a view when the head unit 30 is viewed in a direction indicated by the outline arrow in FIG. 3. Note that in FIG. 3 and FIG. 4, the scanning direction of the heads 31 is indicated.

As shown in FIG. 3, the head unit 30 of the present embodiment includes the plurality of heads 31 (five heads 31 in the present embodiment) that are arranged in the scanning direction. These heads 31 respectively discharge different UV inks. Specifically, the head unit 30 includes the head 31 that discharges a black UV ink, the head 31 that discharges a cyan UV ink, the head 31 that discharges a magenta UV ink, the head 31 that discharges a yellow UV ink, and the head 31 that discharges a white UV ink.

As shown in FIG. 4, the plurality of nozzles are formed on the nozzle surface 31*a* of each head 31 and arranged at predetermined intervals in the scanning direction. An ink chamber and a piezoelectric element (both are not shown) are provided for each nozzle, and a droplet of UV ink is discharged from each nozzle in such a manner that the piezoelectric element is driven to expand or contract the ink chamber.

UV Irradiation Unit

Figure 5:
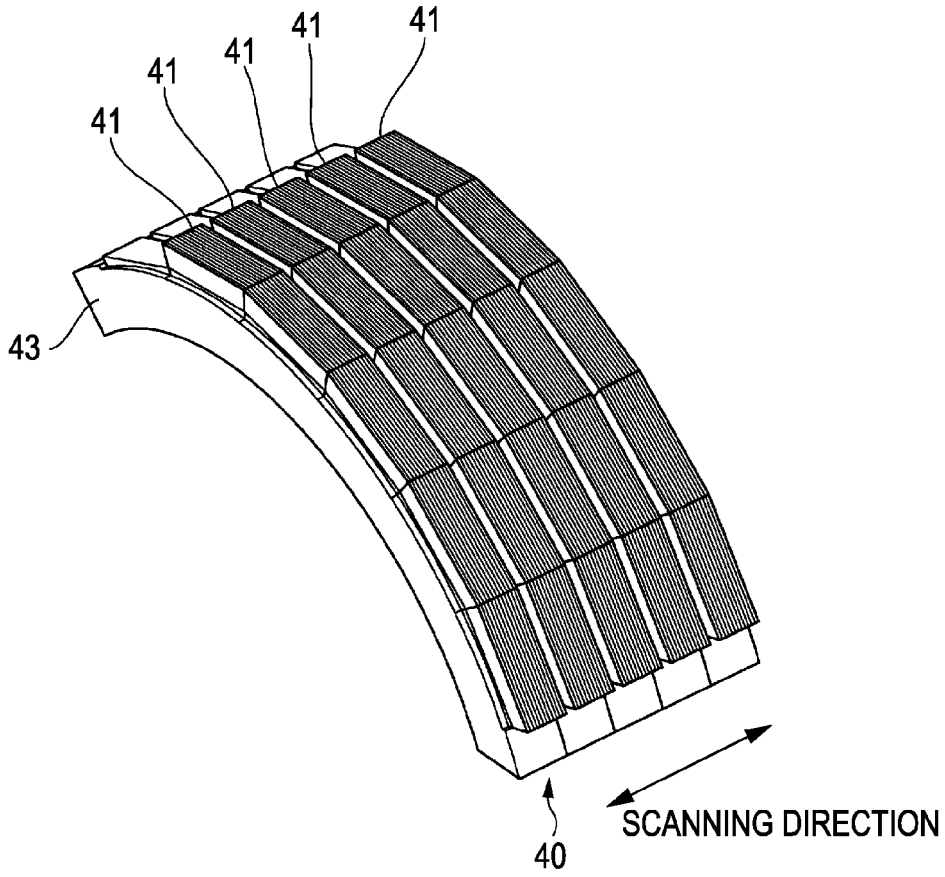
FIG. 5 is a perspective view of a UV irradiation unit.

Next, the UV irradiation unit 40 will be described with reference to FIG. 5. FIG. 5 is a perspective view of the UV irradiation unit 40. Note that in FIG. 5, a direction corresponding to the scanning direction of the heads 31 (in FIG. 5, simply indicated as scanning direction) is indicated by the arrow.

The UV irradiation unit 40 of the present embodiment includes the plurality of lamp units 41 (hereinafter, also referred to as lamp unit columns) that are arranged in the direction in which the rotating drum 20 rotates in correspondence with the number of the heads 31. That is, in the present embodiment, the UV irradiation unit 40 includes the lamp unit column for a black UV ink, the lamp unit column for a cyan UV ink, the lamp unit column for a magenta UV ink, the lamp unit column for a yellow UV ink, and the lamp unit column for a white UV ink. As shown in FIG. 5, these lamp unit columns are assembled to a common holder 43 while being arranged in the direction corresponding to the scanning direction of the heads 31.

As described above, because the lamp unit columns are provided respectively for the UV inks, it is possible to set the wavelength and irradiation intensity of ultraviolet ray irradiated from each lamp unit 41 for a corresponding one of the UV inks. Note that a light source provided for the lamp units 41 may employ a metal halide lamp, a xenon lamp, a carbon-arc lamp, a chemical lamp, a low-pressure mercury lamp, a high-pressure mercury lamp, and the like.

In addition, in the present embodiment, the width of the irradiation surface of each lamp unit 41 (length in the direction corresponding to the scanning direction of the heads 31) is longer than the width of the nozzle surface 31*a* of each head 31 (length in the scanning direction).

Configuration of Control Unit

Figure 6:
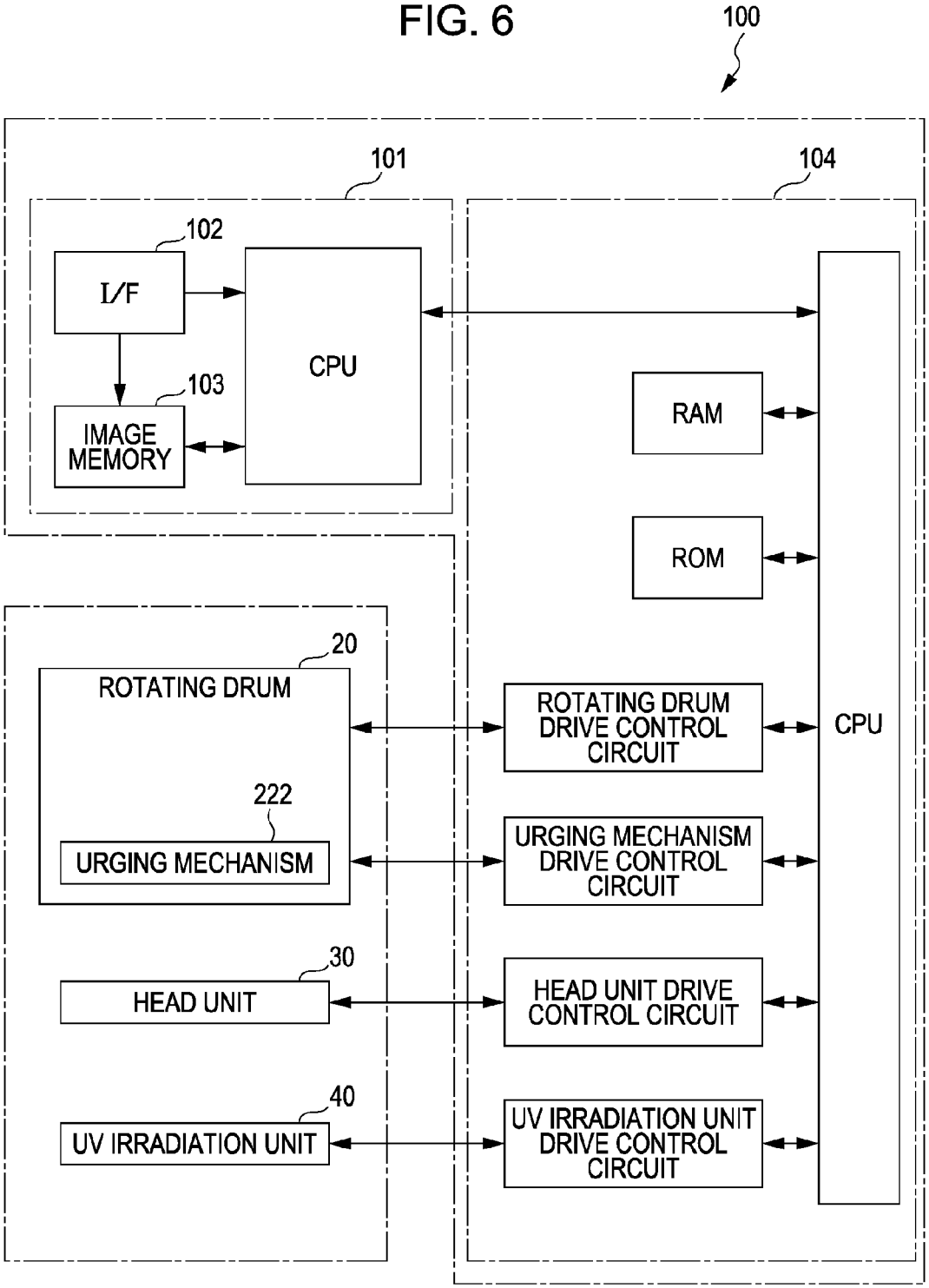
FIG. 6 is a block diagram that shows a control unit of the printer.

Next, the configuration of the control unit 100 will be described with reference to FIG. 6. FIG. 6 is a block diagram that shows the control unit 100 of the printer 10. As shown in FIG. 6, a main controller 101 of the control unit 100 includes an interface 102 (I/F in FIG. 6) for connection with a host computer and an image memory 103 for storing an image signal input from the host computer. As shown in FIG. 6, a sub controller 104 is electrically connected to portions of a printer body (the rotating drum 20, the head unit 30, and the UV irradiation unit 40, and the like). Then, by receiving signals from sensors of the portions, the sub controller 104 detects the states of the portions and controls the portions on the basis of signals input from the main controller 101.

Operation of Printer

Next, an example of operation of the thus configured printer 10 will be described. First, when an image signal is input from the host computer through the interface 102 to the main controller 101 of the printer 10, the sub controller 104 controls the portions of the printer body on the basis of instructions from the main controller 101. Thus, the rotating drum 20 rotates, and the lamp units 41 of the UV irradiation unit 40 irradiate ultraviolet ray.

On the other hand, a sheet of paper supplied from the paper feed unit 60 is transported to the rotating drum 20, and is wound around the rotating drum 20 so that the paper width direction of the sheet of paper is aligned along the rotary shaft 21 of the rotating drum 20. Then, the sheet of paper is held on the holding region 22*a* by a holding mechanism (not shown) provided in the holding region 22*a* of the peripheral surface 22 of the rotating drum 20.

When the sheet of paper is held on the peripheral surface 22 of the rotating drum 20 and rotates together with the rotating drum 20, UV ink is discharged from the nozzles of the heads 31. Then, the UV ink lands on a portion of the sheet of paper, which faces the nozzle surfaces 31*a* of the heads 31. At this time, because the sheet of paper is rotated, the portion of the sheet of paper, which faces the nozzle surfaces 31*a* of the heads 31, changes in a direction that intersects with the paper width direction. As a result, dot lines are formed on the sheet of paper in a direction that intersects with the paper width direction.

In addition, when the portion of the sheet of paper, to which the UV ink has adhered, moves to a position facing the irradiation surfaces of the lamp units 41 in accordance with rotation of the sheet of paper, the lamp units 41 irradiate ultraviolet ray to the UV ink. Thus, the UV ink discharged from the nozzles is irradiated with ultraviolet ray and cured immediately after the UV ink adheres to the sheet of paper. Then, dot lines formed on the sheet of paper are fixed to the sheet of paper.

Note that because the lamp units 41 are provided respectively for the UV inks, the UV ink, which has adhered to the sheet of paper, receives ultraviolet ray from the lamp unit 41 corresponding to a corresponding one of the UV inks.

In addition, in the present embodiment, because the plurality of lamp units 41 are arranged in the direction in which the rotating drum 20 rotates, it is possible to sufficiently irradiate ultraviolet ray to the UV ink that has adhered to the sheet of paper.

When the sheet of paper further rotates and then the portion of the sheet of paper, to which the UV ink has already adhered, reaches again to the position facing the nozzles, the heads 31 move in the scanning direction. After that, the similar operation as in the case of the above is performed. As a result, a UV ink having different color from the UV ink that has been already cured and adhered to the sheet of paper overlappingly adheres to the UV ink. This prevents a UV ink of another color from being mixed with an uncured UV ink.

In addition, as the heads 31 move in the scanning direction, the lamp units 41 also move in the scanning direction. Thus, after the heads 31 are moved as well, the lamp units 41 irradiate ultraviolet ray to UV inks corresponding to the lamp units 41. Note that because the width of the irradiation surface of each lamp unit 41 is longer than the width of the nozzle surface 31*a* of each head 31, even when the timing at which the head 31 moves differs from the timing at which the lamp unit 41 moves, it is possible to sufficiently irradiate ultraviolet ray to the UV ink that has adhered to the sheet of paper.

As a result of the repeated above operation, a dot line of each color is fixed over all image printing area of the sheet of paper. Thus, an image is eventually printed on the sheet of paper. Then, the sheet of paper, on which the image is printed, is separated from the rotating drum 20 and transported to a paper ejection unit 62.

Flushing

When there is a nozzle that has not discharged UV ink for a long time among the nozzles formed on the nozzle surfaces 31*a* of the heads 31, the viscosity of UV ink near that nozzle increases due to vaporization of solvent. As a result of the increase in viscosity of UV ink, clogging occurs in the nozzle that has not discharged UV ink for a long time and, therefore, UV ink cannot be discharged appropriately. For this reason, in the printer 10 of the present embodiment, when there is a nozzle that has not discharged UV ink for a long time, an operation for eliminating clogging of the nozzle by forcibly discharging UV ink from that nozzle (a so-called flushing operation) is performed.

The flushing operation is performed at the time when the nozzles of the heads 31 face the non-holding region 22*b* of the peripheral surface 22 of the rotating drum 20 while the rotating drum 20 is rotating. That is, the flushing operation is performed so that UV ink does not adhere to the holding region 22*a* of the peripheral surface 22 of the rotating drum 20. Thus, in the present embodiment, the flushing operation may also be performed while a sheet of paper is held on the holding region 22*a* (that is, during printing process).

Then, the UV ink discharged from the nozzles for flushing (hereinafter, also referred to as waste ink) is received by the ink receiving belt 200, which is provided inside the rotating drum 20, and scraped by the scraper 220, which is also provided inside the rotating drum 20, to be removed from the ink receiving belt 200. Hereinafter, the ink receiving belt 200 and the scraper 220 will be described, and a procedure for removing waste ink will also be described at the same time.

Ink Receiving Belt and Scraper

Figure 7:
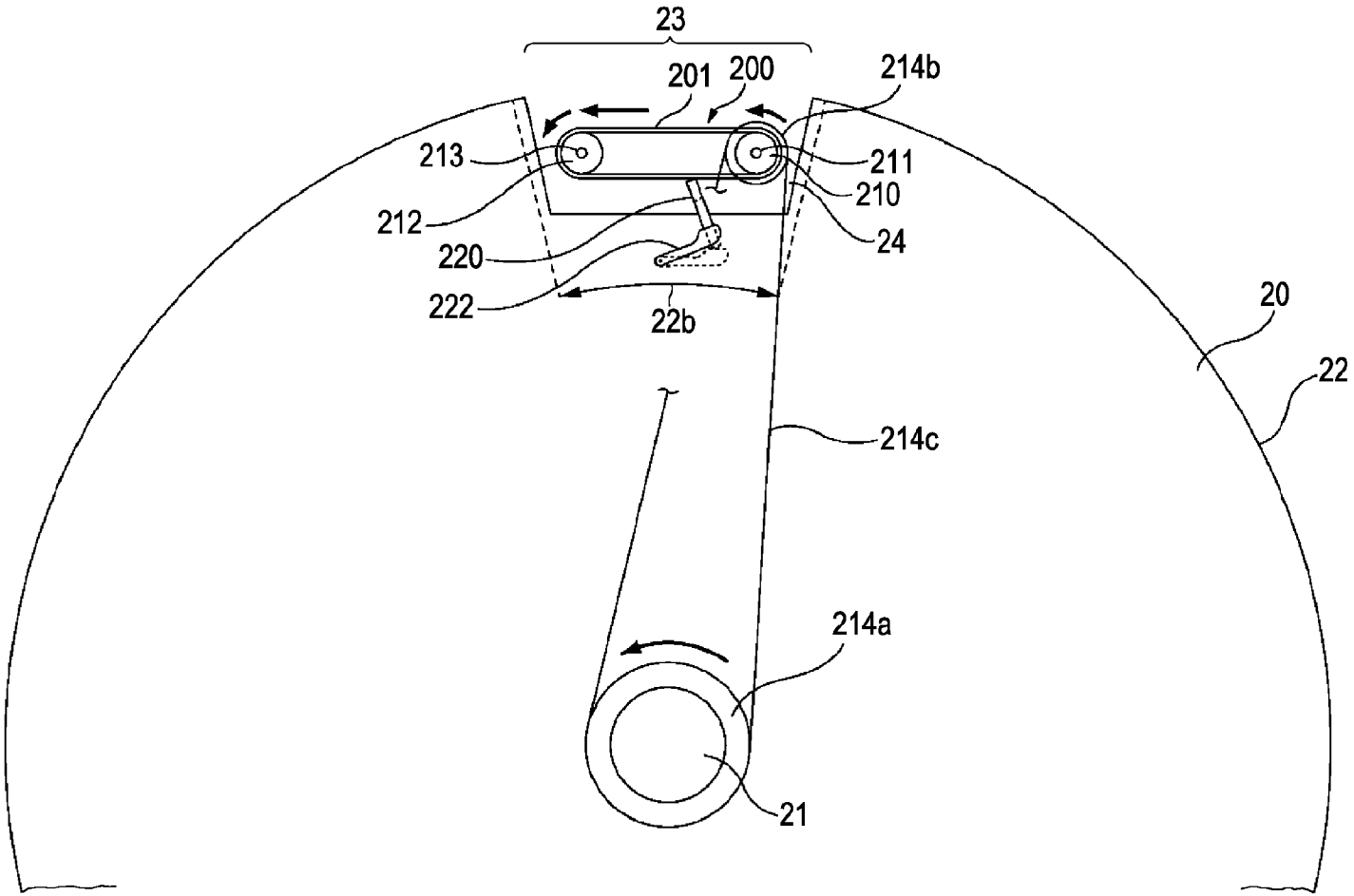
FIG. 7 is an enlarged view of an ink receiving belt and a scraper shown in FIG. 2.

First, the structure of the ink receiving belt 200 and scraper 220 will be described with reference to FIG. 7. FIG. 7 is an enlarged view of the ink receiving belt 200 and scraper 220 shown in FIG. 2. Note that in FIG. 7, for the sake of convenience of description, members that do not appear on the cross-sectional view of FIG. 2 (for example, the rotary shaft 21 of the rotating drum 20, rotary shafts 211 and 213 of two rollers 210 and 212, which loop the ink receiving belt 200, and pulleys 214*a* and 214*b*) are shown.

As shown in FIG. 7, the ink receiving belt 200 and the scraper 220 are provided at a position at which the non-holding region 22*b* is set in the direction in which the rotating drum 20 rotates. More specifically, an opening 23 is formed in the non-holding region 22*b*, and an accommodating portion 24 is formed inside the rotating drum 20 and communicates with the outside of the rotating drum 20 through the opening 23. The accommodating portion 24 accommodates the ink receiving belt 200 and the scraper 220.

The ink receiving belt 200 rotates inside the rotating drum 20 in a state where the ink receiving belt 200 is looped between the two rollers 210 and 212, and receives waste ink on its outer peripheral surface 201. The ink receiving belt 200 of the present embodiment is made of a repellent material such as fluororesin, and a silicon oil is applied to the outer peripheral surface 201.

In addition, the ink receiving belt 200 is detachably assembled to a body of the rotating drum (rotating drum body). Thus, when the ink receiving belt 200 degrades, it is possible to replace the ink receiving belt 200 with a new one. Note that the rotating drum body indicates portions of the rotating drum 20, other than the ink receiving belt 200 and the scraper 220.

The two rollers 210 and 212 for looping the ink receiving belt 200 respectively have the rotary shafts 211 and 213 extending along the rotary shaft 21 of the rotating drum 20. Then, as the two rollers 210 and 212 respectively rotate about the rotary shafts 211 and 213, the ink receiving belt 200 rotates in the direction indicated by the arrows in FIG. 7.

In addition, the pulley 214*b* is rotatably supported by rotary shaft 211 of the one-side roller 210 between the two rollers 210 and 212. The pulley 214*b* is paired with the pulley 214*a* that is rotatably supported by the rotary shaft 21 of the rotating drum 20, and both pulleys 214*a* and 214*b* are coupled by a driving force transmission belt 214*c*. That is, in the present embodiment, a belt and pulley mechanism, which is a transmission mechanism for rotating the ink receiving belt 200, is provided between the rotating drum 20 and the one-side roller 210. Thus, as the rotating drum 20 rotates, driving force is transmitted from the rotating drum 20 to the one-side roller 210 through the belt and pulley mechanism. As a result, the one-side roller 210 rotates, and the ink receiving belt 200 rotates. In this way, in the present embodiment, because no additional driving source for rotating the one-side roller 210 is provided, the size of the printer 10 is reduced.

The scraper 220 contacts the outer peripheral surface 201 of the rotating ink receiving belt 200 to scrape waste ink received by the ink receiving belt 200. The scraper 220 of the present embodiment is made of an elastic member such as rubber, and, as shown in FIG. 7, contacts the outer peripheral surface 201 of the ink receiving belt 200 on the rear side of the ink receiving belt 200 as viewed from the opening 23.

In addition, because the scraper 220, as well as the ink receiving belt 200, is detachably assembled to the rotating drum body, when the scraper 220 degrades, the scraper 220 may be replaced with a new one.

Furthermore, as shown in FIG. 7, an urging mechanism 222 for urging the scraper 220 toward the ink receiving belt 200 is provided. When the urging mechanism 222 urges the scraper 220 (that is, when the urging mechanism 222 is located at a position indicated by the solid line in FIG. 7) the distal end of the scraper 220 contacts the outer peripheral surface 201 of the ink receiving belt 200. On the other hand, when the urging mechanism 222 does not urge the scraper 220 (that is, when the urging mechanism 222 is located at a position indicated by the broken line in FIG. 7), the distal end of the scraper 220 is spaced apart from the outer peripheral surface 201.

By controlling the urging mechanism 222 in this way, the scraper 220 is able to reciprocally move between a rest position at which the scraper 220 is spaced apart from the outer peripheral surface 201 of the ink receiving belt 200 and a contact position at which the scraper 220 contacts the outer peripheral surface 201. Note that the urging mechanism 222 is controlled by the sub controller 104 (see FIG. 6).

Procedure for Removing Waste Ink

Next, a procedure for removing waste ink in the above described configuration will be described with reference to FIG. 8A to FIG. 8F. FIG. 8A to FIG. 8F are views for illustrating the procedure for removing waste ink. Then, the states of the ink receiving belt 200 and scraper 220 change in the order of FIG. 8A, FIG. 8B, FIG. 8C, FIG. 8D, FIG. 8E, and FIG. 8F.

Figure 8A:
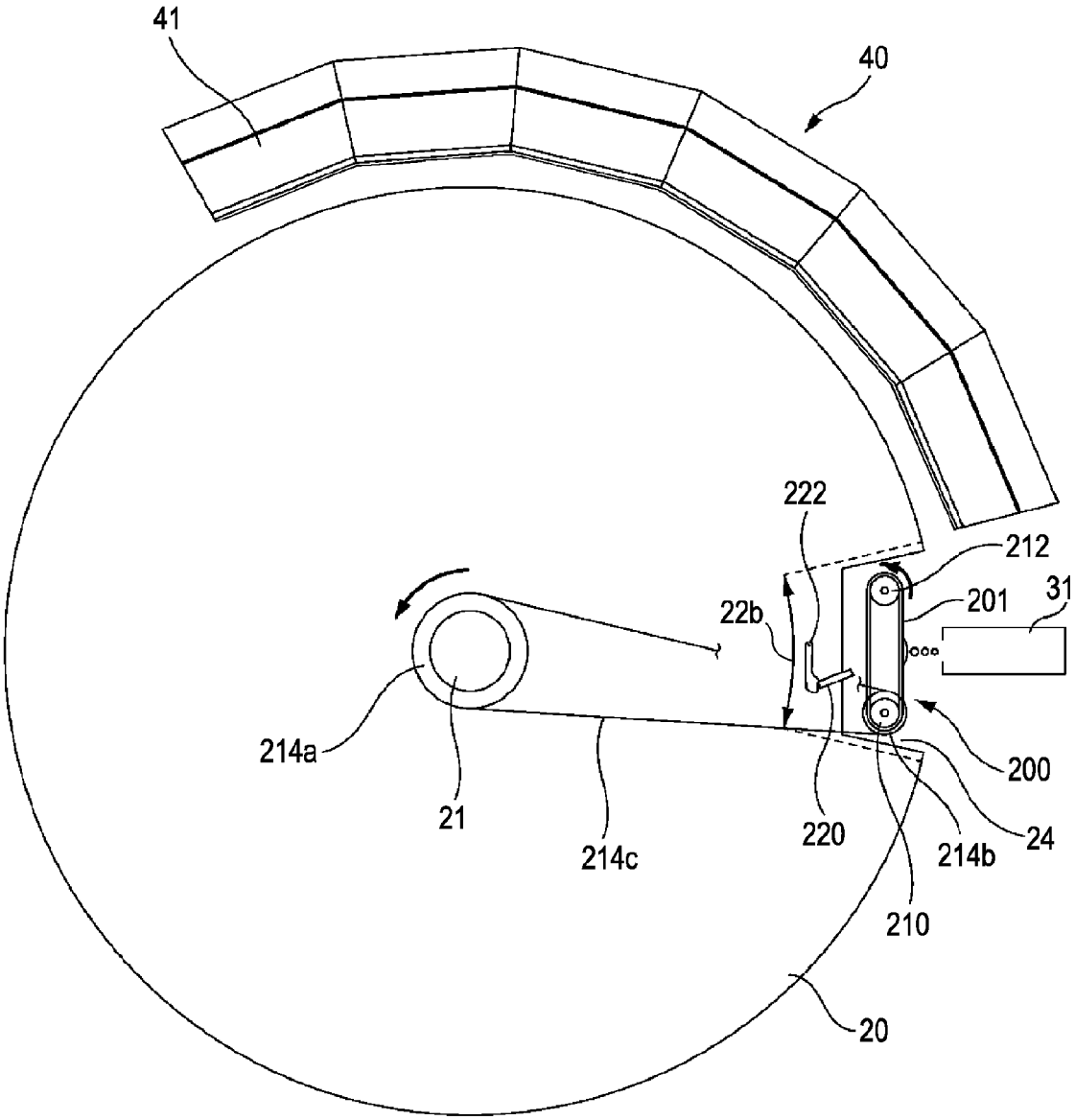
FIG. 8A is a first view for illustrating the procedure for removing waste ink.

The process of removing waste ink starts from a flushing operation as shown in FIG. 8A. That is, in accordance with rotation of the rotating drum 20, when the non-holding region 22*b* of the peripheral surface 22 of the rotating drum 20 moves to the position facing the nozzles of the heads 31, UV ink is discharged from the nozzles. At this time, in accordance with rotation of the rotating drum 20, the ink receiving belt 200 moves to the position facing the nozzles through the opening 23 formed in the non-holding region 22*b*.

During then, driving force is transmitted from the rotating drum 20 to the one-side roller 210 for looping the ink receiving belt 200 and, therefore, the ink receiving belt 200 itself also rotates. Thus, the outer peripheral surface 201 of the ink receiving belt 200 moves in the direction in which the outer peripheral surface 201 rotates. By so doing, the outer peripheral surface 201 moves between a position at which the outer peripheral surface 201 is exposed through the opening 23 (exposed position) and a position at which the outer peripheral surface 201 is not exposed (non-exposed position).

Furthermore, in the present embodiment, the rotational speed of the ink receiving belt 200 is sufficiently lower than the rotational speed of the rotating drum 20. That is, the relative relationship in rotational speed between the ink receiving belt 200 and the rotating drum 20 is such that, while the rotating drum 20 rotates one turn, the ink receiving belt 200 only rotates less than one turn. Note that the rotational speed means the number of revolutions per unit time.

Then, when UV ink (waste ink) discharged from the nozzles for flushing passes through the opening 23 and enters the accommodating portion 24, the ink receiving belt 200 located at a position facing the nozzles receives the waste ink on the outer peripheral surface 201 located at the exposed position during the flushing. As a result, waste ink adheres to the outer peripheral surface 201 as shown in FIG. 8A.

After that, the ink receiving belt 200 rotates, while, in accordance with rotation of the rotating drum 20, moving from the position facing the nozzles through the opening 23 to the position facing the UV irradiation unit 40 (more accurately, the position facing the irradiation surfaces of the lamp units 41). During then, the outer peripheral surface 201, to which waste ink has adhered at the time when the ink receiving belt 200 receives the waste ink, moves in the direction, in which the ink receiving belt 200 rotates, in accordance with rotation of the ink receiving belt 200.

Figure 8B:
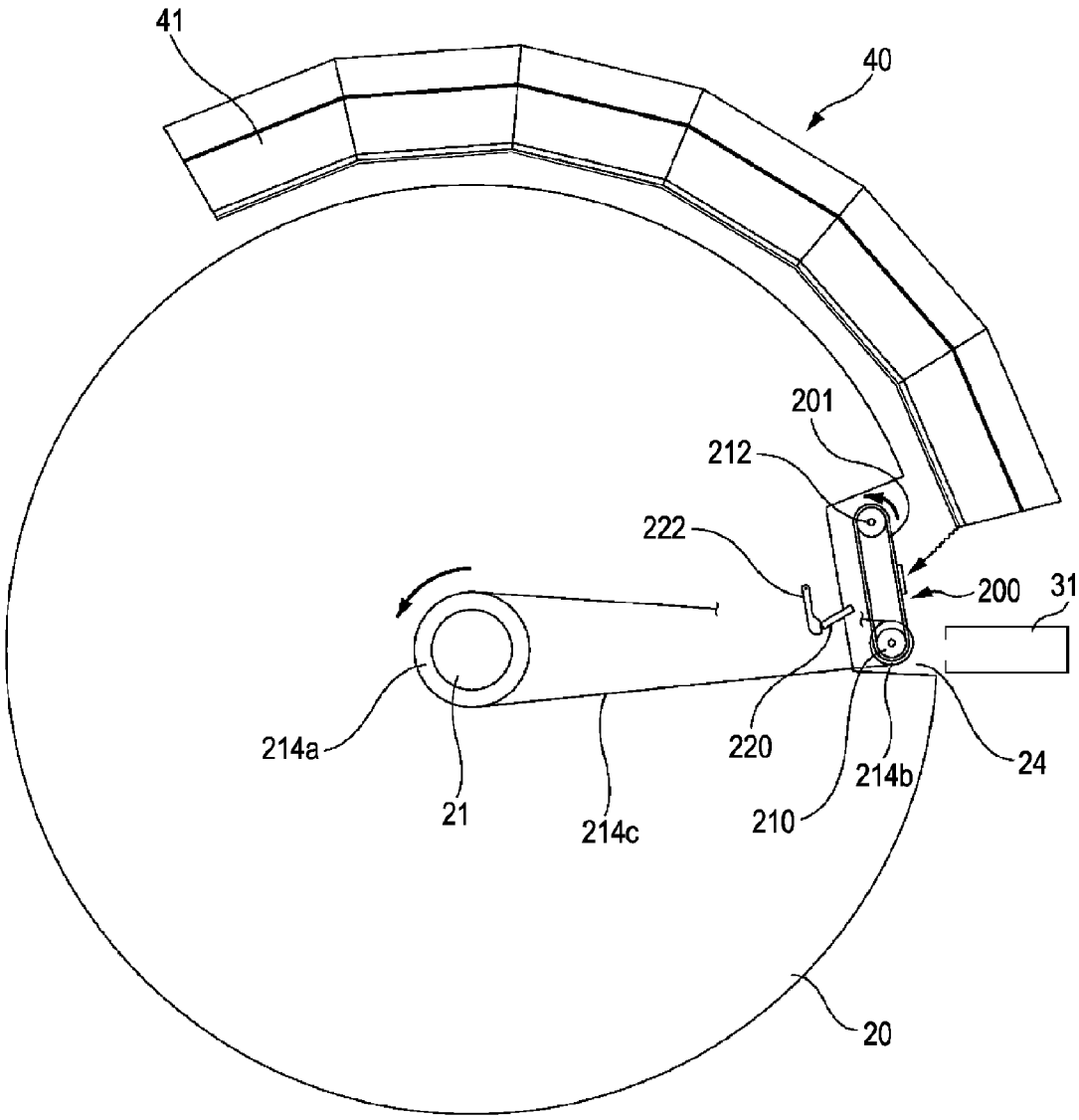
FIG. 8B is a second view for illustrating the procedure for removing waste ink.

When the ink receiving belt 200 faces the UV irradiation unit 40 through the opening 23, as shown in FIG. 8B, the outer peripheral surface 201, to which waste ink has adhered at the time when the ink receiving belt 200 receives the waste ink, is still located at the exposed position and has not reached the non-exposed position.

Then, when the ink receiving belt 200 faces the UV irradiation unit 40 through the opening 23, the UV irradiation unit 40 irradiates ultraviolet ray through the opening 23 to the waste ink that is received at the time when the ink receiving belt 200 is located at the position facing the nozzles. By so doing, the waste ink irradiated with ultraviolet ray initiates to be cured.

In addition, as described above, the plurality of lamp units 41 are arranged in the direction in which the rotating drum 20 rotates, and the ink receiving belt 200 faces the irradiation surfaces of the plurality of lamp units 41 through the opening 23 in accordance with rotation of the rotating drum 20.

Then, in the present embodiment, during a period from the time when the ink receiving belt 200 initiates to face the irradiation surface of the lamp unit 41 at the most upstream side among the plurality of lamp units 41 to the time when the ink receiving belt 200 completes facing the irradiation surface of the lamp unit 41 at the most downstream side, the outer peripheral surface 201, to which waste ink has adhered at the time when the ink receiving belt 200 receives the waste ink, is continuously located at the exposed position. That is, in the present embodiment, at the time when the ink receiving belt 200 completes facing the UV irradiation unit 40, the outer peripheral surface 201, to which the waste ink has adhered, is still located at the exposed position and has not reached the non-exposed position.

On the other hand, while the rotating drum 20 rotates, the UV irradiation unit 40 (more accurately, the plurality of lamp units 41) continuously irradiates ultraviolet ray. That is, at least during a period from the time when the ink receiving belt 200 initiates to face the UV irradiation unit 40 through the opening 23 to the time when the ink receiving belt 200 completes facing the UV irradiation unit 40 in accordance with rotation of the rotating drum 20, the UV irradiation unit 40 irradiates ultraviolet ray.

Figure 8C:
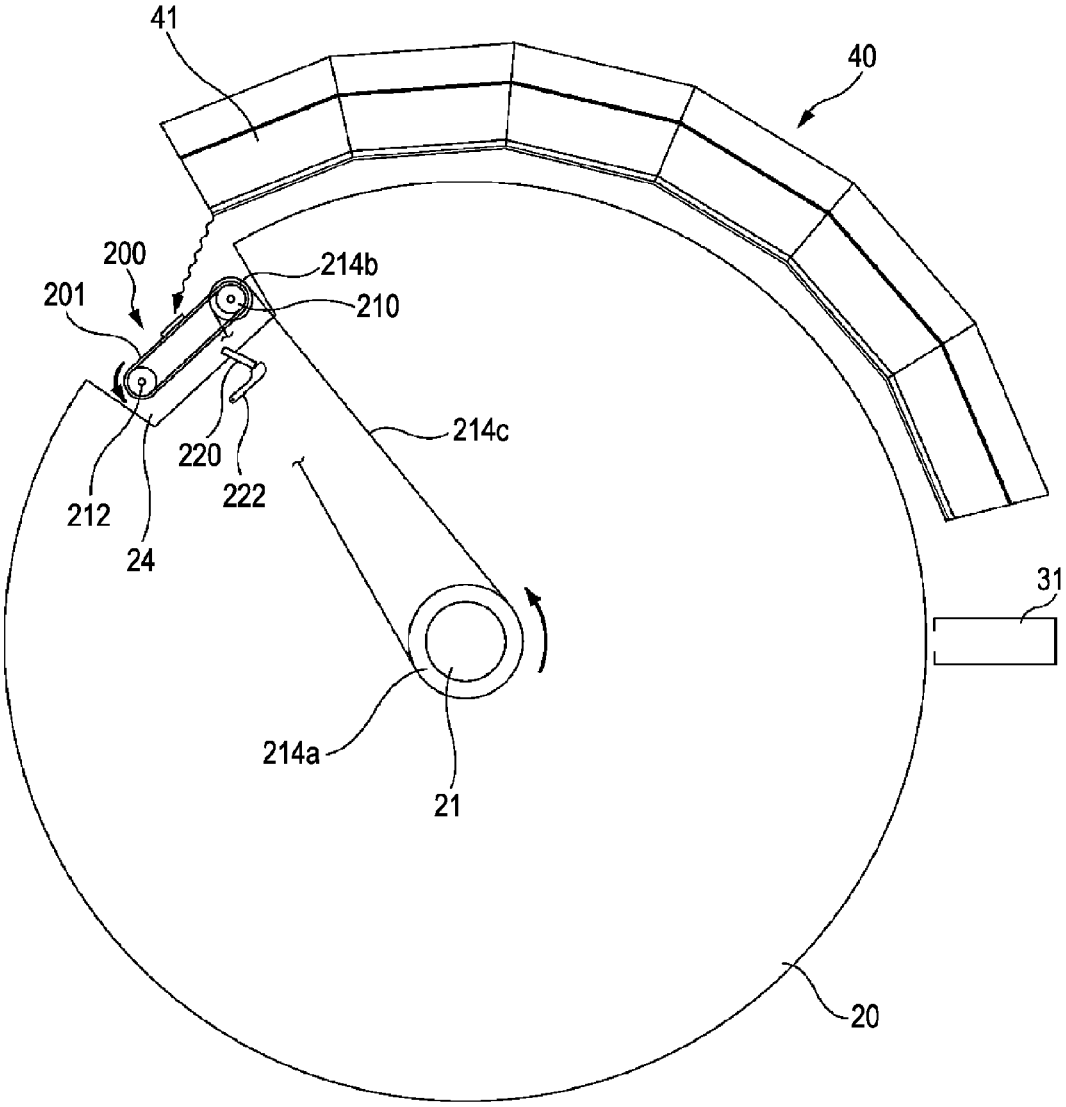
FIG. 8C is a third view for illustrating the procedure for removing waste ink.

Thus, as shown in FIG. 8B and FIG. 8C, during a period from the time when the ink receiving belt 200 initiates to face the UV irradiation unit 40 through the opening 23 to the time when the ink receiving belt 200 completes facing the UV irradiation unit 40 through the opening 23 in accordance with rotation of the rotating drum 20, ultraviolet ray is continuously irradiated to the waste ink that is received at the time when the ink receiving belt 200 is located at the position facing the nozzles.

After that, in accordance with rotation of the rotating drum 20, the ink receiving belt 200 passes the position facing the UV irradiation unit 40 through the opening 23. As the rotating drum 20 further rotates, the ink receiving belt 200 moves to the position facing the UV irradiation unit 40 again. During then, the ink receiving belt 200 itself also rotates, so the outer peripheral surface 201, to which waste ink has adhered at the time when the ink receiving belt 200 receives the waste ink, also moves in the direction in which the ink receiving belt 200 rotates.

Here, as described above, the relative relationship in rotational speed between the ink receiving belt 200 and the rotating drum 20 is such that, while the rotating drum 20 rotates one turn, the ink receiving belt 200 only rotates less than one turn. Furthermore, in the present embodiment, while the outer peripheral surface 201, to which waste ink has adhered at the time when the ink receiving belt 200 receives the waste ink, is located at the exposed position, the ink receiving belt 200 passes multiple times the position facing the UV irradiation unit 40 through the opening 23 in accordance with rotation of the rotating drum 20. That is, the number of times ultraviolet ray is irradiated to the waste ink that has adhered to the outer peripheral surface 201 will be the number of times the ink receiving belt 200 passes the position facing the UV irradiation unit 40 through the opening 23 while the outer peripheral surface 201 is located at the exposed position.

Finally, the outer peripheral surface 201, to which the waste ink has adhered, moves from the exposed position to the non-exposed position in accordance with rotation of the ink receiving belt 200. On the other hand, the waste ink that has adhered to the outer peripheral surface 201 continuously receives ultraviolet ray as described above, and then accumulates in a cured state on the outer peripheral surface 201 to which the waste ink has adhered.

Then, when the scraper 220 is urged by the urging mechanism 222 and located at the contact position, the outer peripheral surface 201, to which the waste ink has adhered, moves to the non-exposed position and then contacts the scraper 220. At this time, the ink receiving belt 200 contacts the scraper 220 while being rotated. By so doing, the waste ink that has adhered to the outer peripheral surface 201 is scraped by the scraper 220 and peels off from the outer peripheral surface 201. Then, the waste ink that has adhered to the outer peripheral surface 201 is removed, and then the ink receiving belt 200 returns to a previous state in which the waste ink has not adhered to the outer peripheral surface 201. The waste ink peeling off from the outer peripheral surface 201 is collected into a waste ink collecting portion (not shown) and is removed.

As described above, in the present embodiment, ultraviolet ray is irradiated to waste ink that is received on the outer peripheral surface 201 at the time when the ink receiving belt 200 is located at the position facing the nozzles, and then the waste ink that is irradiated with ultraviolet ray is scraped and removed by the scraper 220. This is because the more the waste UV ink is cured by receiving ultraviolet ray, the easier the waste UV ink is scraped by the scraper 220.

In addition, because the outer peripheral surface 201, to which waste ink has adhered, moves from the exposed position to the non-exposed position and then the scraper 220 scrapes the waste ink, ultraviolet ray may be continuously irradiated to the waste ink while the outer peripheral surface 201, to which the waste ink has adhered, is located at the exposed position. Particularly, in the present embodiment, during a period from the time when the ink receiving belt 200 initiates to face the UV irradiation unit 40 through the opening 23 to the time when the ink receiving belt 200 completes facing the UV irradiation unit 40, the outer peripheral surface 201, to which the waste ink has adhered, is continuously located at the exposed position, so a duration during which ultraviolet ray is irradiated to the waste ink elongates. Furthermore, while the outer peripheral surface 201, to which waste ink has adhered, is located at the exposed position, the ink receiving belt 200 passes multiple times the position facing the UV irradiation unit 40 through the opening 23, so a duration during which ultraviolet ray is irradiated to the waste ink further elongates. As a result, because waste ink is sufficiently cured and then scraped, the waste ink is easily removed from the ink receiving belt 200.

In addition, as described above, the ink receiving belt 200 of the present embodiment is made of a repellent material, and a silicon oil is applied to the outer peripheral surface 201. Thus, waste ink that has adhered to the outer peripheral surface 201 is less likely to fixedly adhere to the outer peripheral surface 201 even when the waste ink is cured. As a result, waste ink that has adhered to the outer peripheral surface 201 is easily scraped by the scraper 220. Note that when, in place of a silicon oil, a liquid repellent to UV ink is applied to the outer peripheral surface 201 as well, the similar advantageous effect may be obtained.

Incidentally, in the present embodiment, the scraper 220 is not constantly located at the contact position, but the scraper 220 reciprocally moves between the rest position and the contact position. Then, in a period during which the scraper 220 moves from the contact position to the rest position and then returns to the contact position again, the flushing operation is performed multiple times. That is, in the present embodiment, while the scraper 220 is located at the rest position, the ink receiving belt 200 receives waste ink caused by multiple flushing operations. Then, after the ink receiving belt 200 receives waste ink caused by multiple flushing operations, the scraper 220 moves from the rest position to the contact position to scrape the waste ink. Thus, in the present embodiment, the scraper 220 collectively scrapes waste ink caused by multiple flushing operations.

In order to further specifically describe the above operation, subsequently, the procedure for removing waste ink according to the present embodiment will be described.

While the scraper 220 moves from the contact position to the rest position and is located at the rest position, when one flushing operation (for example, a first flushing operation among the multiple flushing operations) is performed, the ink receiving belt 200 moves to the position facing the nozzles through the opening 23 in accordance with rotation of the rotating drum 20. Then, the ink receiving belt 200 receives waste ink, caused by the one flushing operation, on the outer peripheral surface 201 (hereinafter, first outer peripheral surface 201*a*) located at the exposed position at the time when the ink receiving belt 200 is located at the position facing the nozzles through the opening 23 at the time of the one flushing operation. The waste ink adheres to the first outer peripheral surface 201*a* and is cured through the above described procedure, and then accumulates on the first outer peripheral surface 201*a* (see FIG. 8B and FIG. 8C).

After that, in a state where the scraper 220 is located at the rest position, when a flushing operation (for example, a second flushing operation among the multiple flushing operations, and hereinafter, referred to as following flushing operation) subsequent to the one flushing operation is performed, the ink receiving belt 200 moves again to the position facing the nozzles through the opening 23 in accordance with rotation of the rotating drum 20. Then, the ink receiving belt 200 receives waste ink, caused by the following flushing operation, on the outer peripheral surface 201 (hereinafter, referred to as second outer peripheral surface 201*b*) located at the exposed position when the ink receiving belt 200 is located at the position facing the nozzles through the opening 23 at the time of the following flushing operation.

Incidentally, during times from the one flushing operation to the following flushing operation, the ink receiving belt 200 rotates. Thus, the first outer peripheral surface 201*a* located at the exposed position at the time of the one flushing operation and the second outer peripheral surface 201*b* located at the exposed position at the time of the following flushing operation may be the different outer peripheral surfaces 201.

Figure 8D:
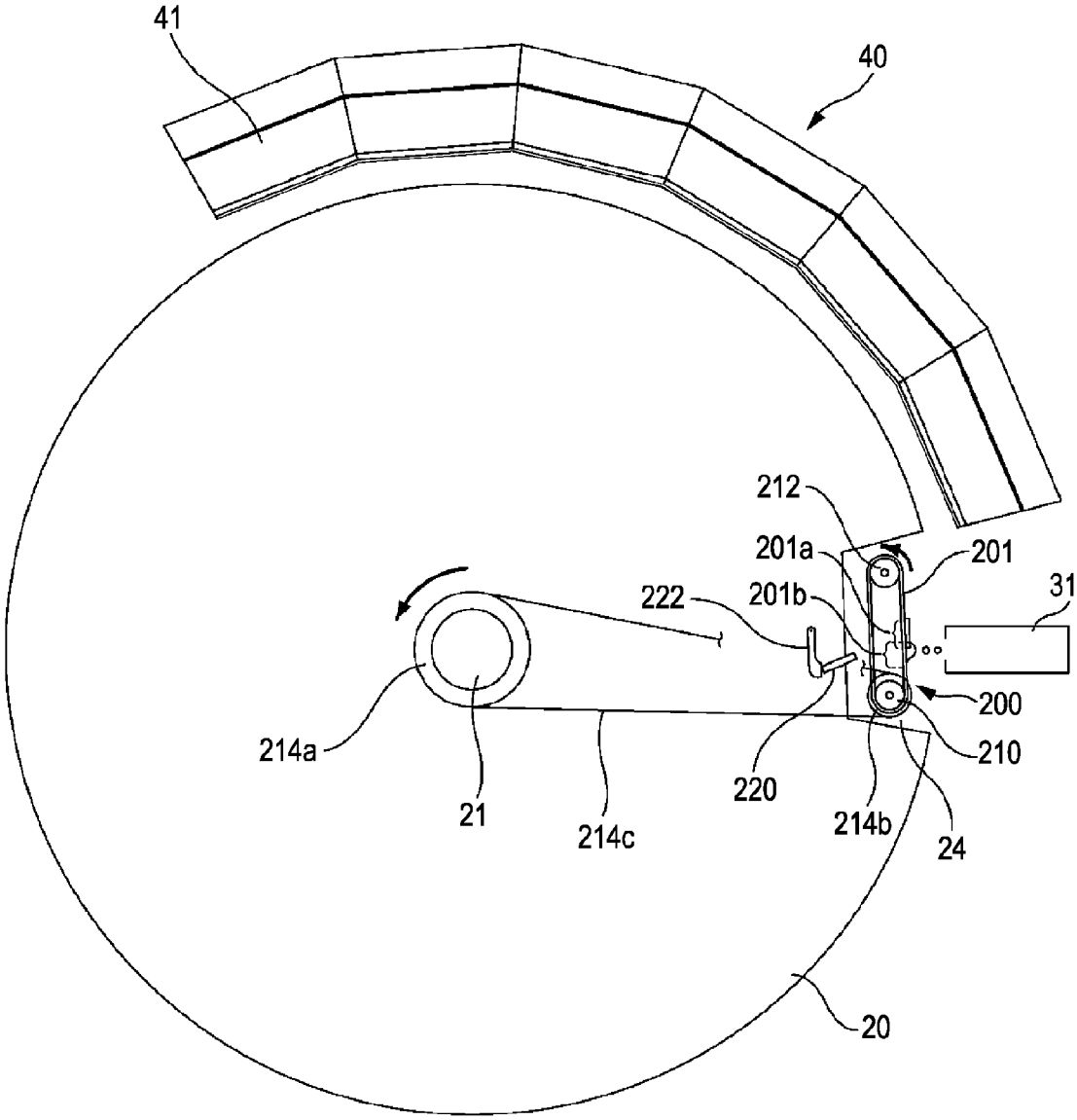
FIG. 8D is a fourth view for illustrating the procedure for removing waste ink.

On the other hand, in the present embodiment, a time interval from the one flushing operation to the following flushing operation is adjusted so that the first outer peripheral surface 201*a* overlaps the second outer peripheral surface 201*b* (in the present embodiment, the second outer peripheral surface 201*b* partially overlaps the first outer peripheral surface 201*a*). As a result, as shown in FIG. 8D, waste ink caused by the following flushing operation is overlapped on the waste ink caused by the one flushing operation.

Then, the waste ink caused by the following flushing operation adheres to the second outer peripheral surface 201*b* in a state where the waste ink is overlapped on the waste ink caused by the one flushing operation, and is then cured and accumulates on the second outer peripheral surface 201*b*. As a result, waste ink accumulates in a laminated manner on the outer peripheral surface 201 of the ink receiving belt 200 (more accurately, a portion at which the first outer peripheral surface 201*a* overlaps the second outer peripheral surface 201*b*).

After that, while the scraper 220 is located at the rest position, the above series of operations are repeatedly performed. That is, when the flushing operation is performed multiple times while the scraper 220 is located at the rest position, the ink receiving belt 200 moves to the position facing the nozzles through the opening 23 in each flushing operation in accordance with rotation of the rotating drum 20. Then, the ink receiving belt 200 receives waste ink, caused by each flushing operation, on the outer peripheral surface 201 located at the exposed position at the time when the ink receiving belt 200 is located at the position facing the nozzles through the opening 23 at the time of each flushing operation.

Figure 8E:
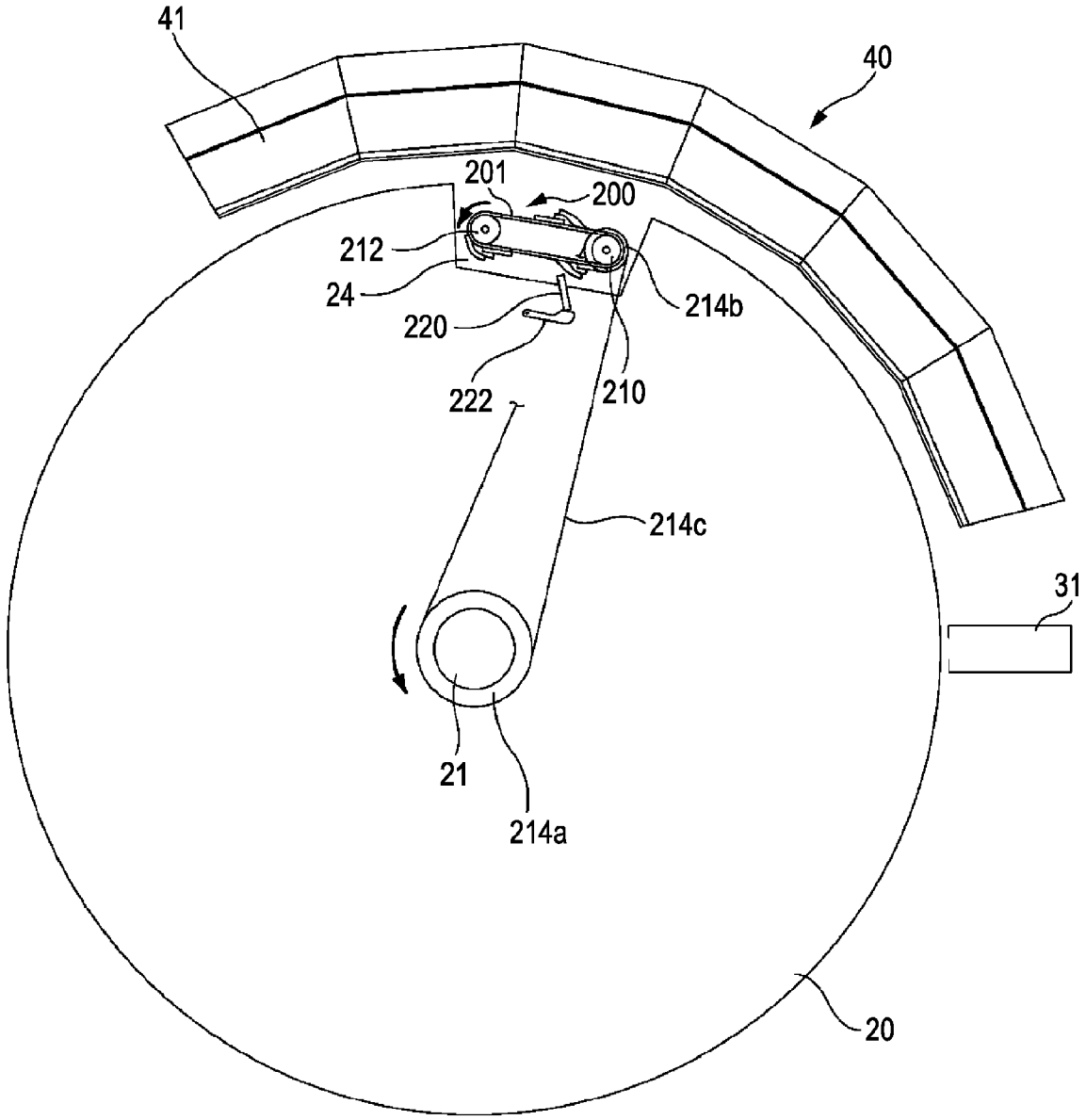
FIG. 8E is a fifth view for illustrating the procedure for removing waste ink.

As described above, the ink receiving belt 200 rotates while receiving waste ink caused by each of the multiple flushing operations. As a result, waste ink accumulates on the outer peripheral surface 201 of the ink receiving belt 200. On the other hand, because the time interval between the flushing operations is adjusted, as shown in FIG. 8E, waste ink accumulates in a laminated manner.

Then, after waste ink generated through the multiple flushing operations adheres on the outer peripheral surface 201, the sub controller 104 instructs the urging mechanism 222 to urge the scraper 220. Thus, the scraper 220 moves from the rest position to the contact position. That is, in the present embodiment, while the scraper 220 is positioned at the rest position, waste ink adheres to both the first outer peripheral surface 201*a* and the second outer peripheral surface 201*b*. After waste ink adheres to both surfaces, the scraper 220 moves from the rest position to the contact position.

Figure 8F:
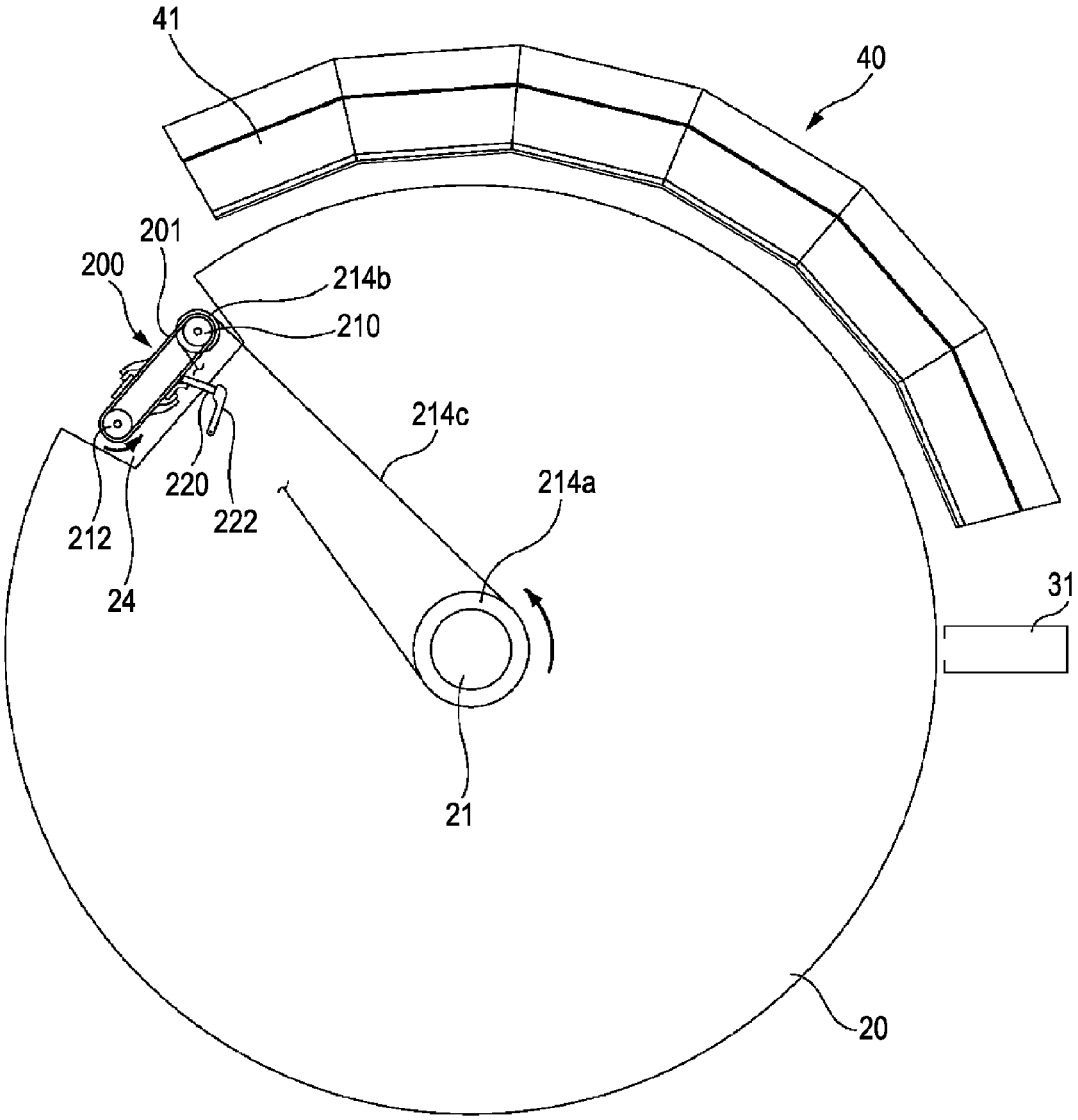
FIG. 8F is a sixth view for illustrating the procedure for removing waste ink.

After that, when the outer peripheral surface 201 moves to the position at which the scraper 220 contacts the outer peripheral surface 201 in accordance with rotation of the ink receiving belt 200, as shown in FIG. 8F, waste ink accumulated in a laminated manner on the outer peripheral surface 201 is scraped by the scraper 220 and peels off from the outer peripheral surface 201. That is, in the present embodiment, after waste ink adheres to both the first outer peripheral surface 201*a* and the second outer peripheral surface 201*b*, the scraper 220 scrapes the waste ink that has adhered to both surfaces.

When the scraper 220 scrapes the waste ink that has adhered to the outer peripheral surface 201, the sub controller 104 cancels urging by the urging mechanism 222. Thus, the scraper 220 moves from the contact position to the rest position. On the other hand, waste ink that has adhered to the outer peripheral surface 201 is removed and, as a result, the ink receiving belt 200 returns to a previous state in which the ink receiving belt 200 has not received waste ink and then prepares for receiving waste ink caused by the next flushing operation.

Advantageous Effects of Printer of Present Embodiment

In the printer 10 of the present embodiment, the rotating drum 20 includes the ink receiving belt 200 for receiving UV ink (that is, waste ink) discharged from the nozzles for flushing and the scraper 220 for removing waste ink, received by the ink receiving belt 200, from the ink receiving belt 200. With the above printer 10, it is possible to appropriately remove waste ink received by the ink receiving belt 200 without decreasing the throughput.

That is, as described in the background of the related art, in the existing printer, when the removing member removes waste ink, received by the receiving member, from the receiving member, rotation of the rotating drum 20 is sometimes stopped.

Specifically, in the existing printer, the receiving member that receives waste ink may possibly be provided for the rotating drum 20, while the removing member that removes waste ink from the receiving member may possibly be provided for the printer body (portions of the printer, other than the rotating drum 20). In the above printer, only when the receiving member is located at the position facing the removing member in accordance with rotation of the rotating drum 20, the removing member removes waste ink received by the receiving member. Then, when the receiving member faces the removing member in order to sufficiently remove waste ink received by the receiving member, rotation of the rotating drum 20 may possibly be stopped. If rotation of the rotating drum 20 is stopped during print operation, the print operation is interrupted and, therefore, the throughput of the printer decreases.

In contrast, in the printer 10 of the present embodiment, both the ink receiving belt 200 which corresponds to the receiving member and the scraper 220 which corresponds to the removing member are provided inside the rotating drum 20. Thus, inside the rotating drum 20, the scraper 220 contacts the outer peripheral surface 201 of the ink receiving belt 200, and scrapes and removes waste ink received by the ink receiving belt 200.

Thus, it is not necessary to stop rotation of the rotating drum when the scraper 220 removes waste ink from the ink receiving belt 200, and a duration during which the scraper 220 is in contact with the ink receiving belt 200 may also be sufficiently ensured. As a result, without decreasing the throughput of the printer 10, it is possible to appropriately remove waste ink received by the ink receiving belt 200.

In addition, in the present embodiment, because the ink receiving belt 200 rotates, the outer peripheral surface 201 of the ink receiving belt 200 circulates between the position at which waste ink is allowed to adhere and the position at which the adhered waste ink is scraped by the scraper 220. As a result, for example, even when a large amount of waste ink is caused by multiple flushing operations, the ink receiving belt 200 appropriately receives waste ink on the outer peripheral surface 201 and then the scraper 220 appropriately removes the waste ink that has adhered to the outer peripheral surface 201.

Alternative Embodiments

The printer, which is an example of the fluid discharging apparatus, is mainly described on the basis of the above embodiment; however, the above described embodiment of the invention is intended to easily understand the aspects of the invention, and does not limit the scope of the invention. The aspects of the invention may be modified or improved without departing from the spirit of the invention. Of course, the aspects of the invention also encompass equivalents of them.

In addition, in the above embodiment, the fluid discharging apparatus that discharges UV ink as an example of fluid is described; however, it is not limited. The aspects of the invention may also be implemented as an apparatus that discharges another fluid (including an ink other than a UV ink, a liquid other than an ink, a liquid element in which particles of functional material are dispersed, a fluid element such as a gel, a solid that can be flowed and discharged as a fluid), other than a UV ink.

The fluid discharging apparatus may be, for example, a fluid discharging apparatus, which discharges a liquid that contains materials such as electrode materials or color materials, used for manufacturing a liquid crystal display, an electroluminescence (EL) display and a field emission display, or the like, in the form of dispersion or solution, a fluid discharging apparatus, which discharges a bio-organic material, used for manufacturing a bio-chip, or a fluid discharging apparatus, which discharges a fluid as a sample, used as a precision pipette. Furthermore, the fluid discharging apparatus may be a fluid discharging apparatus that discharges a lubricating oil pinpoint to a precision machine, such as a clock, a watch or a camera, a fluid discharging apparatus that discharges a transparent resin liquid, such as an ultraviolet curing resin, for forming a microscopic semi-spherical lens (optical lens) used for an optical communication element, or the like, on a substrate, a fluid discharging apparatus that discharges an etchant, such as acid or alkali, in order to apply etching treatment to the substrate, or the like, a fluid discharging apparatus that discharges a gel, or a fine particle discharge recording apparatus that discharges a solid, which is, for example, particles such as a toner. Then, the aspects of the invention may be applied to any one of these fluid discharging apparatuses.

What is claimed is:

1. A fluid discharging apparatus comprising:

a nozzle for discharging fluid onto a medium; and a rotating body that has a holding region for holding the medium and a non-holding region on its peripheral surface and that rotates while facing a peripheral surface toward the nozzle, wherein the rotating body includes:

a receiving member for receiving fluid discharged from the nozzle for flushing when the non-holding region faces the nozzle;

a removing member separate from the receiving member for removing the fluid, received by the receiving member, from the receiving member;

a rotating drum that has an opening formed in the non-holding region, the removing member configured to remove the fluid from the receiving member while the rotating body rotates; and a transmission mechanism configured to transmit a driving force of the rotating body to the receiving member during rotation of the rotating shaft such that the receiving member is rotating when the rotating drum is rotating, wherein the receiving member is a belt that rotates in response to the driving force in a state where the belt is looped between two rollers inside the rotating drum while receiving fluid discharged from the nozzle for flushing and passing through the opening on the peripheral surface, and the removing member includes a scraping member that scrapes the fluid received by the belt in such a manner that the scraping member contacts an outer peripheral surface of the rotating belt, wherein the fluid is an ultraviolet curable ink, the fluid discharging apparatus further comprises an irradiation unit that faces the peripheral surface of the rotating drum at a position downstream of the nozzle in a direction in which the rotating drum rotates and that is used for irradiating ultraviolet ray to the ultraviolet curable ink that has adhered to the medium, the belt moves from a position facing the nozzle through the opening to a position facing the irradiation unit through the opening in accordance with rotation of the rotating drum, the irradiation unit irradiates ultraviolet ray to ultraviolet curable ink, received by the belt when the belt is located at the position facing the nozzle, at the time when the belt is moved and located at a position facing the irradiation unit, and the scraping member scrapes the ultraviolet curable ink to which the ultraviolet ray is irradiated.

2. The fluid discharging apparatus according to claim 1, wherein the outer peripheral surface of the belt is configured to move between an exposed position at which the outer peripheral surface is exposed through the opening and a non-exposed position at which the outer peripheral surface is not exposed as the belt rotates, and after the outer peripheral surface, to which ultraviolet curable ink adheres at the time when the belt receives the ultraviolet curable ink, moves from the exposed position to the non-exposed position as the belt rotates, the scraping member is configured to scrape the ultraviolet curable ink that has adhered to the outer peripheral surface.

3. The above fluid discharging apparatus according to claim 2, wherein the belt is configured to rotate while moving from the position facing the nozzle through the opening to the position facing the irradiation unit through the opening in accordance with rotation of the rotating drum, and, after that, the belt passes the position facing the irradiation unit, and a relative relationship in rotational speed between the belt and the rotating drum is such that, while the rotating drum rotates one turn, the belt only rotates less than one turn.

4. The fluid discharging apparatus according to claim 3, wherein the irradiation unit irradiates ultraviolet ray at least during a period from the time when the belt initiates to face the irradiation unit through the opening to the time when the belt completes facing the irradiation unit through the opening in accordance with rotation of the rotating drum, and at the time when the belt completes facing the irradiation unit, the outer peripheral surface, to which ultraviolet curable ink adheres at the time when the belt receives the ultraviolet curable ink, is still located at the exposed position and has not reach the non-exposed position.

5. The fluid discharging apparatus according to claim 4, wherein the scraping member moves between a rest position at which the scraping member is spaced apart from the outer peripheral surface of the belt and a contact position at which the scraping member contacts the outer peripheral surface of the belt, the belt moves to the position facing the nozzle through the opening in each flushing in accordance with rotation of the rotating drum, the belt receives ultraviolet curable ink on a first outer peripheral surface that is located at the exposed position when the belt is located at the position facing the nozzle through the opening at one flushing while the scraping member is located at the rest position, the belt then receives ultraviolet curable ink on a second outer peripheral surface, overlapped on the first outer peripheral surface, that is located at the exposed position when the belt is located at the position facing the nozzle through the opening at a flushing after the one flushing, and after ultraviolet curable ink has adhered to both the first outer peripheral surface and the second outer peripheral surface, the scraping member moves from the rest position to the contact position to scrape the ultraviolet curable ink that has adhered to both the first and second outer peripheral surfaces.

6. The fluid discharging apparatus according to claim 1, wherein the transmission mechanism transmits the driving force from the rotating drum to one of the two rollers in order to rotate the belt.

7. The fluid discharging apparatus according to claim 1, wherein the belt is made of a repellent material, and a silicon oil is applied to the outer peripheral surface of the belt.

8. The fluid discharging apparatus according to claim 1, wherein the belt and the scraping member are detachable from a body of the rotating drum.

9. A fluid discharging apparatus comprising:

a nozzle for discharging fluid onto a medium; and a rotating body that has a holding region for holding the medium and a non-holding region on its peripheral surface and that rotates while facing a peripheral surface toward the nozzle, wherein the rotating body includes:

a receiving member for receiving fluid discharged from the nozzle for flushing when the non-holding region faces the nozzle; and a removing member for removing the fluid, received by the receiving member, from the receiving member; and a rotating drum that has an opening formed in the non-holding region, the removing member configured to remove the fluid from the receiving member while the rotating drum rotates, wherein the receiving member rotates when the rotating drum rotates, the receiving member is a belt that rotates in a state where the belt is looped between two rollers inside the rotating drum while receiving fluid discharged from the nozzle for flushing and passing through the opening on its outer peripheral surface, the removing member is a scraping member that scrapes the fluid received by the belt in such a manner that the scraping member contacts the outer peripheral surface of the rotating belt, the scraping member moves between a rest position at which the scraping member is spaced apart from an outer peripheral surface of the belt and a contact position at which the scraping member contacts the outer peripheral surface of the belt, the belt moves to the position facing the nozzle through the opening in each flushing in accordance with rotation of the rotating drum, the belt receives ultraviolet curable ink on a first outer peripheral surface that is located at the exposed position when the belt is located at the position facing the nozzle through the opening at one flushing while the scraping member is located at the rest position, the belt then receives ultraviolet curable ink on a second outer peripheral surface, overlapped on the first outer peripheral surface, that is located at the exposed position when the belt is located at the position facing the nozzle through the opening at a flushing after the one flushing, and after ultraviolet curable ink has adhered to both the first outer peripheral surface and the second outer peripheral surface, the scraping member moves from the rest position to the contact position to scrape the ultraviolet curable ink that has adhered to both the first and second outer peripheral surfaces, wherein a time interval between the flushing is adjusted so that the ultraviolet curable ink adhered to both the first outer peripheral surface and second outer peripheral surface accumulates in a laminated manner.

* * * * *